US011377862B1

(12) United States Patent
Waldron

(10) Patent No.: US 11,377,862 B1
(45) Date of Patent: Jul. 5, 2022

(54) VALLEY ROOF BRACKET

(71) Applicant: Richard Waldron, Parsonsfield, ME (US)

(72) Inventor: Richard Waldron, Parsonsfield, ME (US)

( * ) Notice: Subject to any disclaimer, the term of this patent is extended or adjusted under 35 U.S.C. 154(b) by 0 days.

(21) Appl. No.: 17/476,572

(22) Filed: Sep. 16, 2021

(51) Int. Cl.
*E04G 3/26* (2006.01)
*E04G 5/04* (2006.01)
*E04G 3/22* (2006.01)

(52) U.S. Cl.
CPC ..... *E04G 3/265* (2013.01); *E04G 3/22* (2013.01); *E04G 5/041* (2013.01)

(58) Field of Classification Search
CPC .... E04G 1/15; E04G 3/22; E04G 3/24; E04G 3/26; E04G 3/246; E04G 2655/041; E04G 3/265; E04G 5/041
See application file for complete search history.

(56) References Cited

U.S. PATENT DOCUMENTS 1,152,685 A * 9/1915 Winn ..... E04G 3/26 248/237
1,365,996 A * 1/1921 Herwick ..... E04G 3/265 248/237
2,888,225 A * 5/1959 McQuin ..... E04G 5/041 248/237
3,265,156 A * 8/1966 Jacobs ..... E04H 3/16 182/113
3,526,296 A * 9/1970 Stevens ..... E04G 3/265 182/45
3,908,793 A * 9/1975 Vaughn ..... E04G 5/046 182/82
4,082,161 A * 4/1978 Johnson ..... E04G 3/24 182/82
4,785,606 A * 11/1988 Burton ..... E04D 15/025 52/749.12
4,919,230 A * 4/1990 Langer ..... E04G 1/15 182/186.8
5,113,971 A 5/1992 Violet
5,318,148 A * 6/1994 Franco ..... E04D 15/00 182/45
5,908,083 A 6/1999 Hamilton
6,045,102 A * 4/2000 Terenzoni ..... E04D 15/00 248/238
6,220,390 B1 * 4/2001 Pike ..... E04D 15/02 182/45
6,269,905 B1 * 8/2001 Smith ..... E04D 15/02 182/45
6,470,646 B1 * 10/2002 Bryant ..... E04G 3/26 182/206
6,698,702 B2 3/2004 Macri et al.
6,732,835 B1 5/2004 Souto
67,298,101 5/2004 Macri
(Continued)

FOREIGN PATENT DOCUMENTS

DE 19622400 A1 * 12/1996 ..... E04G 1/15
KR 102071783 B1 * 1/2020 ..... E04G 5/08

*Primary Examiner* — Colleen M Chavchavadze
(74) *Attorney, Agent, or Firm* — Cramer Patent & Design, PLLC; Aaron R. Cramer

(57) ABSTRACT

A valley roof bracket is an adjustable V-shaped bracket having an upper cross-member upon which a triangular shaped platform may adjustably be positioned. The device may be secured to an angular side of a pitched roof.

20 Claims, 5 Drawing Sheets

(56) References Cited

U.S. PATENT DOCUMENTS

| | | | | |
|---|---|---|---|---|
| 7,493,737 | B2 * | 2/2009 | Smith | E04D 15/00 182/45 |
| 8,505,685 | B1 | 8/2013 | Rayfield | |
| 8,595,989 | B1 * | 12/2013 | Greene | E04G 3/20 52/82 |
| 9,493,957 | B2 * | 11/2016 | Miller | E04G 3/243 |
| 9,938,732 | B1 * | 4/2018 | Hay, Jr. | E04G 1/24 |
| 10,053,874 | B2 * | 8/2018 | Mickan | E04G 3/243 |
| 2006/0059858 | A1 * | 3/2006 | Layman | E04D 15/02 52/749.12 |
| 2008/0302605 | A1 * | 12/2008 | St-Germain | E04G 1/36 182/223 |

* cited by examiner

VALLEY ROOF BRACKET

RELATED APPLICATIONS

Non-applicable.

FIELD OF THE INVENTION

The present invention relates generally to a roof bracket and more specifically to a roof bracket having a valley.

BACKGROUND OF THE INVENTION

Anyone involved in the roofing business will tell you what a strenuous business it is. A typical day involves carrying heavy loads, enduring high temperatures, and scorching sun, climbing steep roofs all the while working at dangerous elevations above ground. Anything that improves safety, reduces work, or allows for a better job is welcome. To this regard, roofers commonly use roof jacks, consisting of wood planks suspended in straps that are nailed into the sheathing.

These jacks provide the roofer with a more level and stable platform to work from as well as reduce the risk of falling. While certainly useful on conventional sections of inclined roofs, they cannot be used in valleys where sections of sloped roof come together at a perpendicular angle. Accordingly, there exists a need for a means by which roofers can be provided a temporary stable and level surface at roof valleys to increase safety. The development of the valley roof bracket fulfills this need.

SUMMARY OF THE INVENTION

To achieve the above and other objectives, the present invention provides for valley roof jack has an upper horizontal surface, a lower horizontal surface which is disposed below the upper horizontal surface, a horizontal support which is attached below the upper horizontal surface and the lower horizontal surface by a pivoting fastener and a locking fastener, an inward support and an outward support which supports the horizontal support, and a hanging ring which is disposed at a junction between the inward support and the outward support and is secured by one of the fasteners. The pivoting fastener and the locking fastener join the horizontal support to the inward support and the inward support to the outward support.

The upper horizontal surface and the lower horizontal surface may be adapted to be kneeled upon directly by a user. The upper horizontal surface and the lower horizontal surface may be used as a support for a board. The upper horizontal surface and the lower horizontal surface may be pivoted along the pivoting fastener, while the locking fastener may ride in a pivot track for both the upper horizontal surface and the lower horizontal surface. The locking fastener passes through a pair of pivot tracks before connecting to the horizontal support. An upper end of the outward support includes an adjustable fastening pin that may be positioned in an adjustable height slot that accommodates a roof having a plurality of different pitches. The pivoting fastener and the adjustable fastening pin may join the horizontal support, the inward support, and the outward support to produce triangular support.

An outward edge of the horizontal support may have a stop flange to hold one or more jack boards. The horizontal support, the inward support, and the outward support may include a plurality of angular reinforcements for increased strength. The hanging ring may be used to hang the valley roof jack when not being used such as in storage. The inward support may rest against the valley while the hanging ring remains accessible for other fastening purposes.

The hanging ring may be used to hang one or more tools, supplies or other items when the valley roof jack is being utilized on a roof. The valley roof jack may be secured to a roof surface by a nailing surface secured to the upper horizontal surface by a hinge. The nailing surface may include a plurality of first keyed holes to allow for easy securing to a roof surface via one or more fasteners. The nailing surface may be connected on opposite sides of the upper horizontal surface and the lower horizontal surface respectively. The valley roof jack may be positioned between two roof surfaces that join together at a valley.

The valley roof jack may be positioned in the valley and fastened to the roof surfaces using the nailing surface along with a plurality of first fasteners. The valley roof jack may be a support surface for one or two roof planks while supported with one or more conventional roof jacks. A standing seam roof connector which may have an attachment block with four attachment cams added to the valley roof jack when it is used on a standing seam roof. The attachment block may be removed when it is tapped in an opposite direction from a standing seam lock path and is lifted free.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
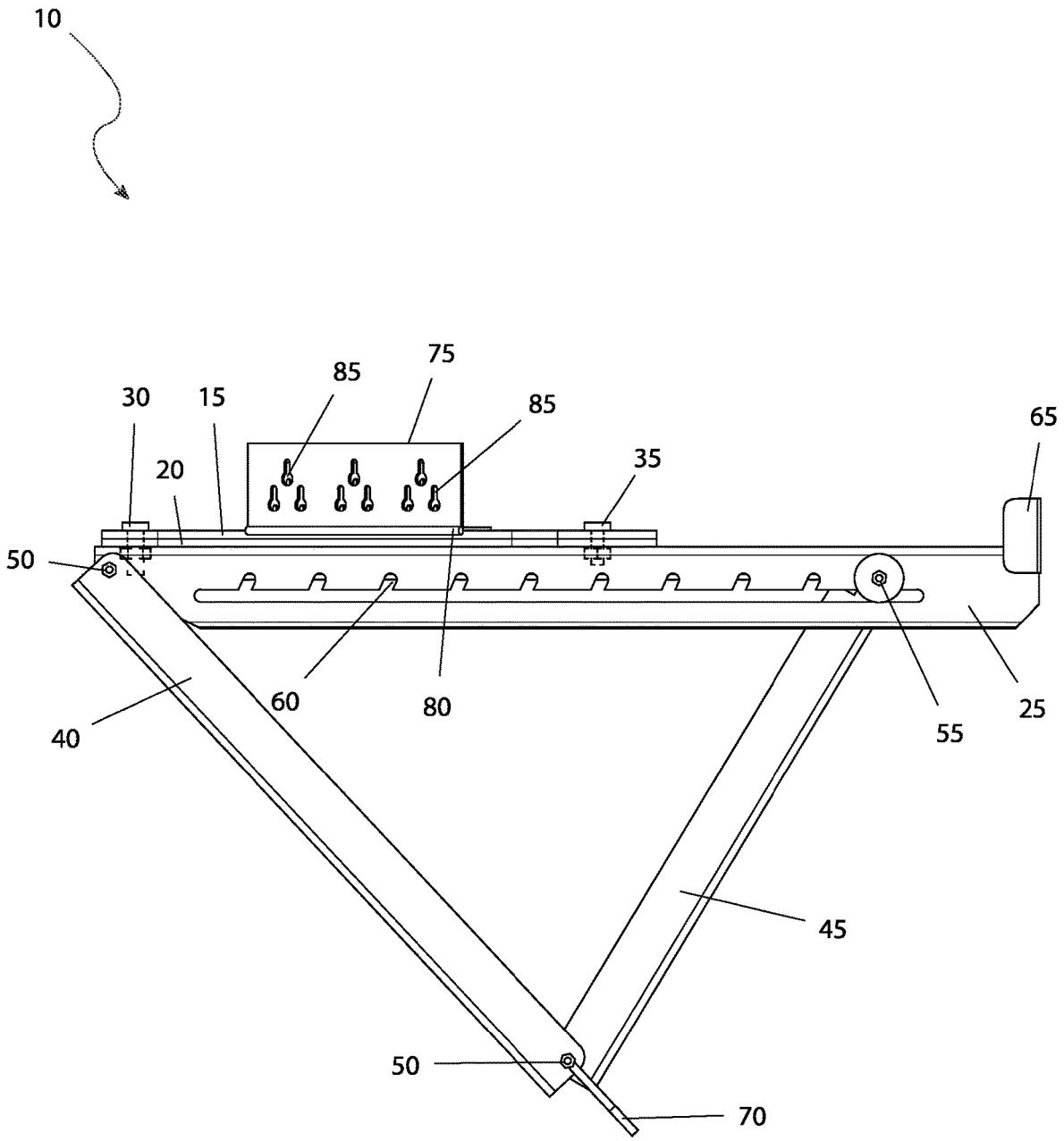
FIG. 1 is a side view of the valley roof jack, according to the preferred embodiment of the present invention.

10 valley roof jack
15 upper horizontal surface
20 lower horizontal surface
25 horizontal support
30 pivoting fastener
35 locking fastener
40 inward support
45 outward support
50 pivoting fastener
55 adjustable fastening pin
60 adjustable height slot
65 stop flange
70 hanging ring
75 nailing surface
80 hinge

85 first keyed hole
90 roof surface
95 valley
100 first fastener
105 pivot track
110 angular travel path "a"
115 roof plank
120 angular reinforcement
125 triangular support
130 standing seam roof connector
135 attachment block
140 attachment cam
145 second fastener
150 flange
155 mounting rod
160 knuckle joint
165 clip connector
170 second keyed hole
175 standing seam lock path "s"
180 locking travel path "t"

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a side view of the valley roof jack 10, according to the preferred embodiment of the present invention is disclosed. The valley roof jack (herein also described as the "roof jack") 10, provides for an adjustable apparatus for use in valley areas 95 of roofs 90. The roof jack 10 provides for an upper horizontal surface 15 and a lower horizontal surface 20, which may be kneeled upon directly by the user, or used as a support for a board. Such a configuration will be described in greater detail herein below. The upper horizontal surface 15 and the lower horizontal surface 20 are attached to a horizontal support 25 by a pivoting fastener 30 and a locking fastener 35 (both of which are shown by partially dashed lines due to their hidden nature). In turn, the horizontal support 25 is supported by an inward support 40 and an outward support 45. A set of two (2) pivoting fasteners 50 join the horizontal support 25 to the inward support 40 and the inward support 40 to the outward support 45. The upper end of the outward support 45 is provided with an adjustable fastening pin 55 that is positioned in an adjustable height slot 60. The adjustable height slot 60 accommodates roofs 90 of different pitches. The very outward edge of the horizontal support 25 is provided with a stop flange 65 to hold jack boards, should they be used. A hanging ring 70, provided at the junction between the inward support 40 and the outward support 45 and is secured by one (1) of the pivoting fasteners 50. The hanging ring 70 is used to hang the roof jack 10 when not being used such as in storage. The hanging ring 70 may also be used to hang tools, supplies or other items when the roof jack 10 is being utilized on a roof 90. The roof jack 10 is secured to a roof surface by a nailing surface 75 secured to the upper horizontal surface 15 by a hinge 80. The nailing surface 75, envisioned to be approximately eight to ten inches (8-10 in.) long, and is provided with multiple first keyed holes 85 to allow for easy securing to roof surfaces 90 via fasteners such as nails or screws.

Figure 2:
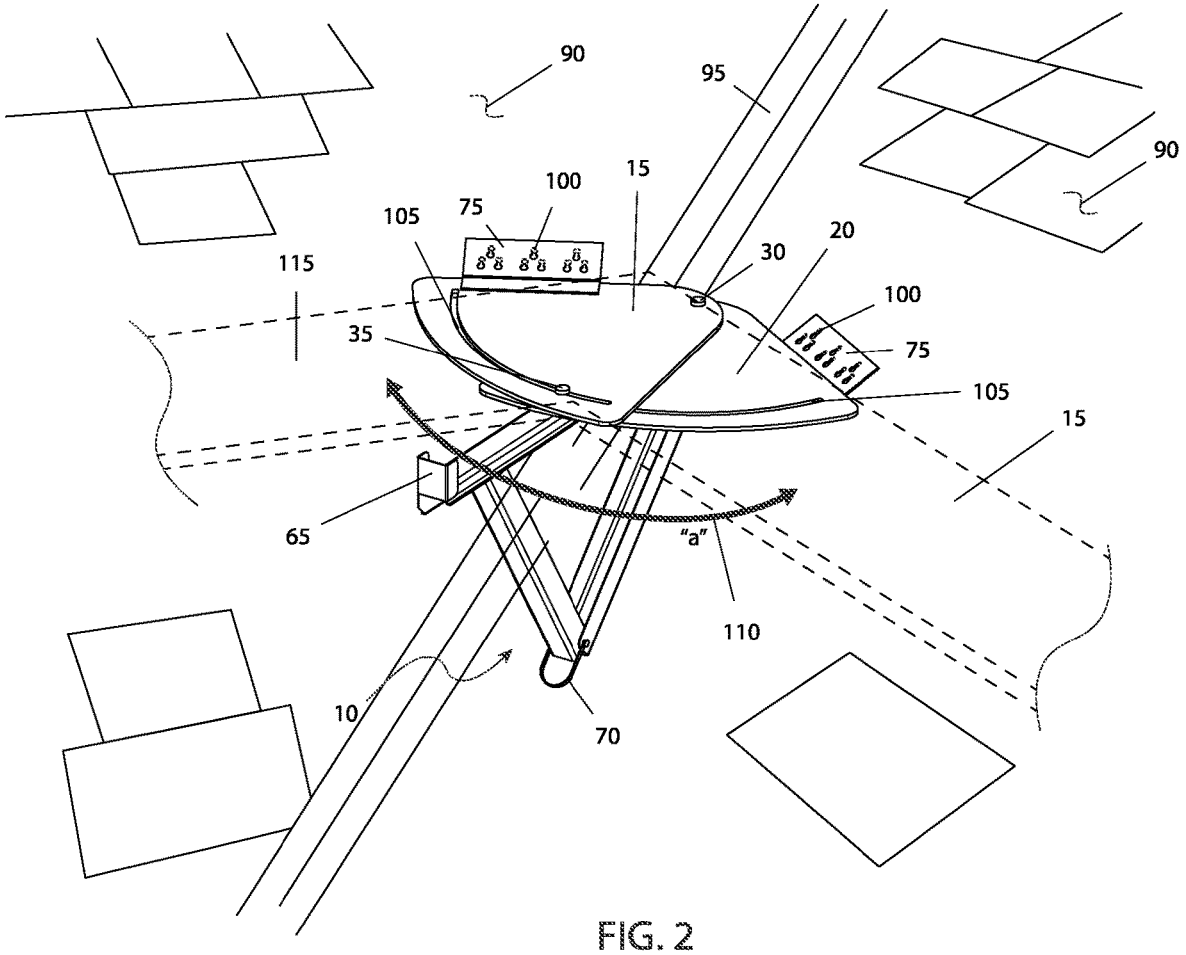
FIG. 2 is a perspective view of the valley roof jack, shown in a utilized state on a shingled roof, according to the preferred embodiment of the present invention.

Referring next to FIG. 2, a perspective view of the roof jack 10, shown in a utilized state on a shingled roof 90, according to the preferred embodiment of the present invention is depicted. The roof jack 10 is positioned between two (2) roof surfaces 90 that join together at a valley 95 in a typical fashion. The configuration of the roof surfaces 90 as shown in FIG. 2 indicates a ninety-degree (90°) configuration. However, the present invention will accommodate other angles of connection. Additionally, the roof surface 90 indicates a composite shingle for purposes of illustration. However, other types of roof surfaces 90 such as metal roofs, membrane roofs, tile roofs, slate roofs, wood shingle roofs and the like may also benefit from the teachings of the present invention. As such, the use of the any particular configuration of valley 95, slope of roof surfaces 90, type of roof surfaces 90, and the like, are not intended to be limiting factors of the present invention.

The roof jack 10 is positioned in the valley 95 and fastened to the roof surfaces 90 using the nailing surface 75 along with appropriate first fasteners 100 such as nails or screws. The upper horizontal surface 15 and the lower horizontal surface 20 are pivoted along the pivoting fastener 30, while the locking fastener 35 rides in a pivot track 105 for both the upper horizontal surface 15 and the lower horizontal surface 20. The locking fastener 35 is secured when an appropriate angular travel path "a" 110 has been obtained. The inward support 40 rests against the valley 95 while the hanging ring 70 remains accessible for other fastening purposes. As aforementioned described, the roof jack 10, may be used as a work platform for the roofer by itself for working around the area of a valley 95. It may also be used as a support surface for one (1) or two (2) roof planks 115 while the other end is supported with conventional roof jacks (not shown). The roof planks 115 are depicted via a dashed line for purposes of clarity and their optional nature). The roof planks 115 are prevented from accidental dislodgement by the stop flange 65.

Figure 3:
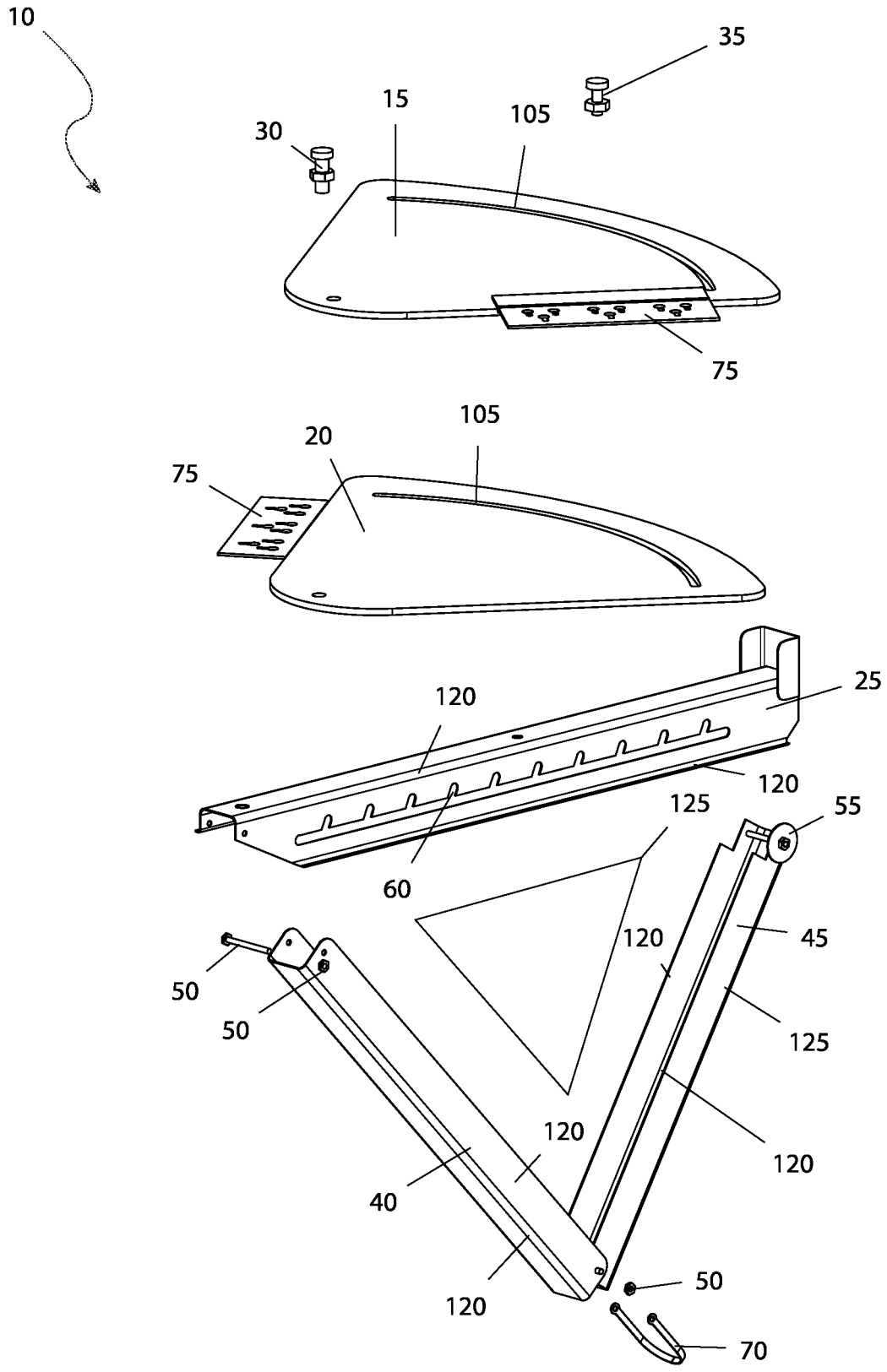
FIG. 3 is an exploded view of the valley roof jack, according to the preferred embodiment of the present invention.

Referring now to FIG. 3, an exploded view of the roof jack 10, according to the preferred embodiment of the present invention is shown. The upper horizontal surface 15 and the lower horizontal surface 20 are joined together by the pivoting fastener 30 and the locking fastener 35, with the locking fastener 35 passing through the two (2) pivot track 105 before connecting to the horizontal support 25. The nailing surface 75 is connected on opposite sides of the upper horizontal surface 15 and the lower horizontal surface 20 respectively. The horizontal support 25, the inward support 40 and the outward support 45 are provided with multiple angular reinforcements 120 to provide for increased strength. The exact quantity or method of angular reinforcements 120 is not intended to be a limiting factor of the present invention. The adjustable height slot 60 is also provided on the opposite side of the horizontal support 25, although not shown due to illustrative limitations. The pivoting fastener 50 and the adjustable fastening pin 55 join the horizontal support 25, the inward support 40 and the outward support 45 as aforementioned described to produce triangular support 125 that is physically strong and capable of supporting hundreds of pounds. The hanging ring 70 is secured to the exterior of the joint formed by the inward support 40 and the outward support 45 with one (1) of the pivoting fasteners 50.

Figure 4:
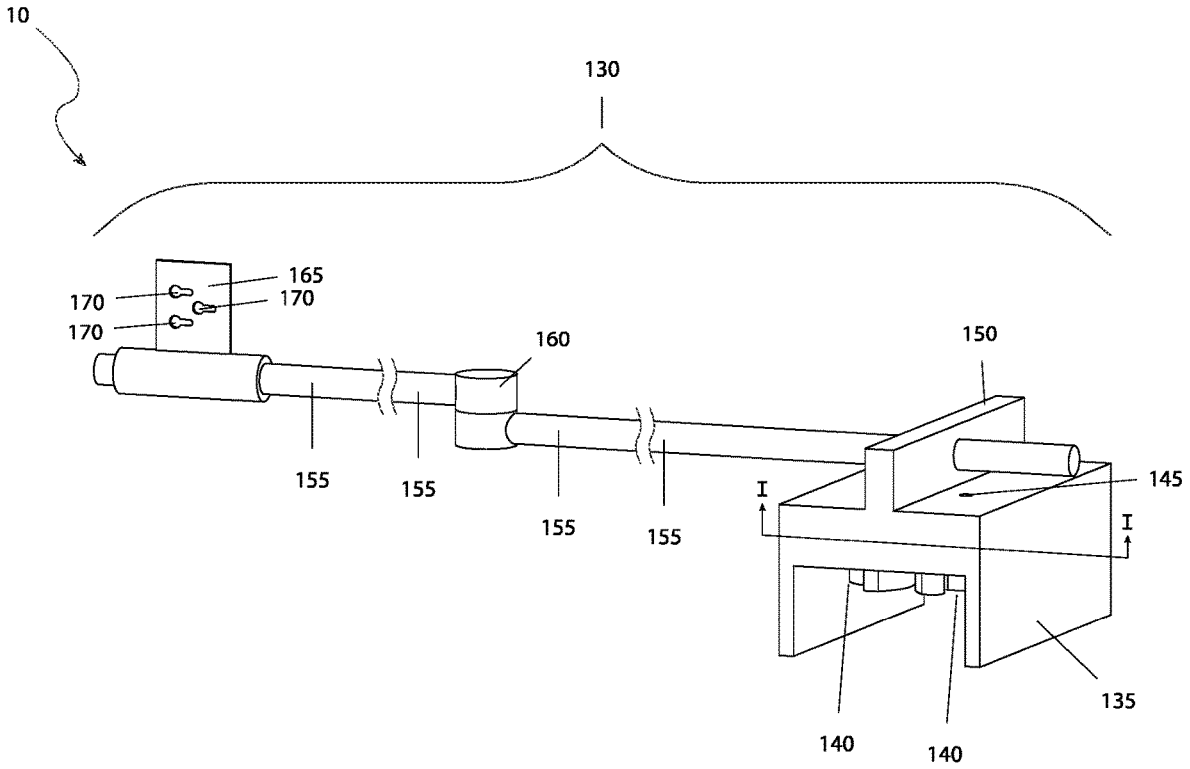
FIG. 4 is a perspective view of the standing seam roof connector as used with the valley roof jack on standing seam roofs, according to the preferred embodiment of the present invention.

Referring next to FIG. 4, a perspective view of the standing seam roof connector 130 as used with the jack 10 on roof surfaces 90 that are standing seam roofs, according to the preferred embodiment of the present invention is disclosed. The standing seam roof connector 130 is added to the roof jack 10 when it is used on a standing seam roof. The standing seam roof connector 130 consists of an attachment block 135 with four (4) attachment cams 140 on the underside. Note that only two (2) of the four (4) attachment cams 140 are shown due to illustrative limitations. Further detail on the attachment cams 140 will be provided herein below.

The attachment cams 140 are attached to the attachment block 135 by four (4) second fasteners 145 (of which only three (3) are shown due to illustrative limitations). A flange 150 is provided on top of the attachment block 135 which connects a mounting rod 155. A knuckle joint 160 is located in the middle of the mounting rod 155 to allow for angular movement. The distal end of the mounting rod 155 is provided with a clip connector 165 for securement of the standing seam roof connector 130 to the roof jack 10. A set of second keyed holes (similar is functionality and shape as the first keyed holes 85 (as shown in FIG. 1)) receive fasteners such as mounting pins. During use of the standing seam roof connector 130, the user would attach the attachment block 135 to the standing seam of the roof and attach the clip connector 165 to the nailing surface 75 to hold the roof jack 10 in place without the necessity of installing first fasteners 100 (as shown in FIG. 2).

Figure 5:
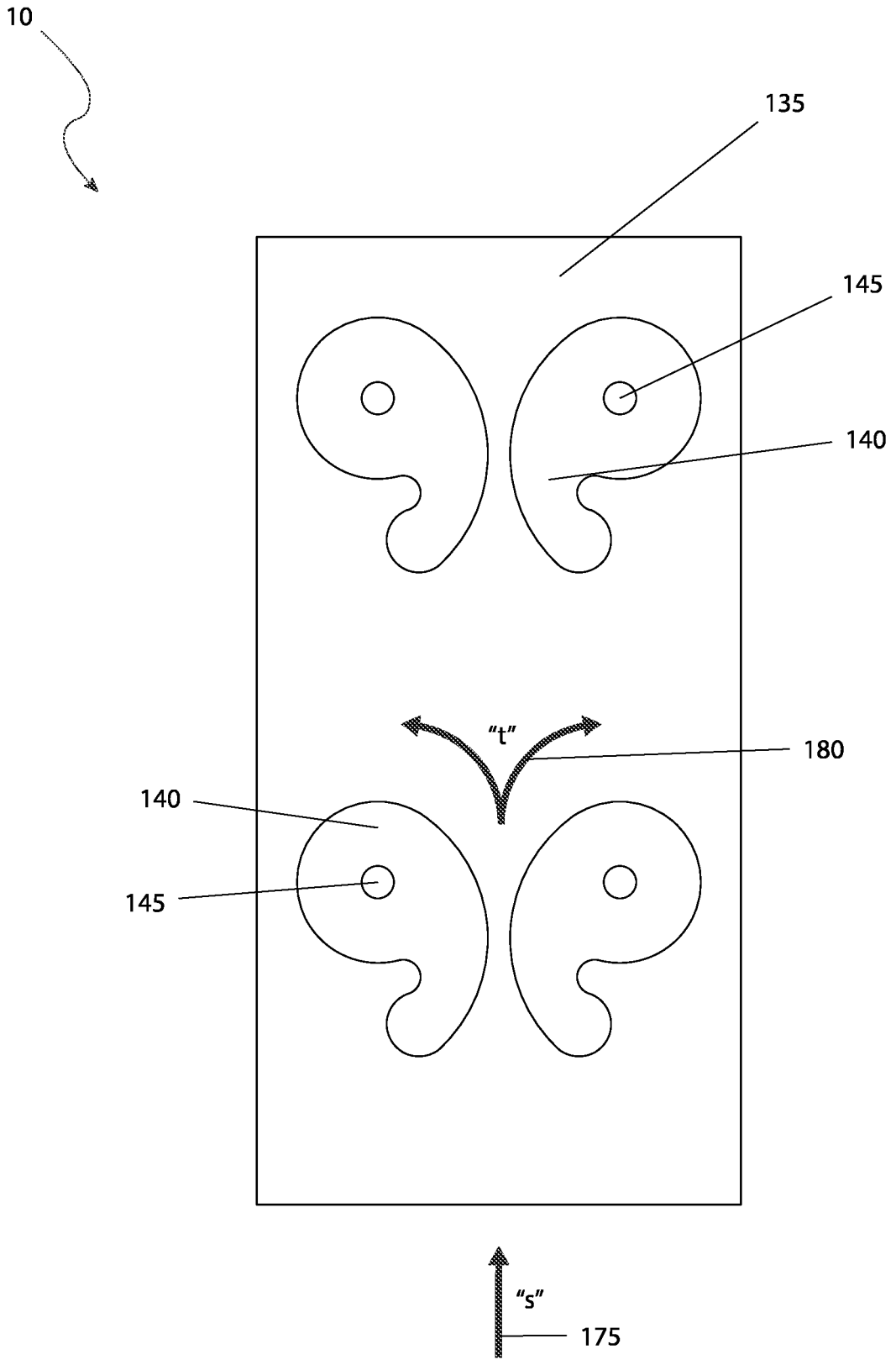
FIG. 5 is a sectional view of the standing seam roof connector, as used with the valley roof jack, as seen along a Line I-I, as shown in FIG. 4.

Referring finally to FIG. 5, a sectional view of the standing seam roof connector 130, as used with the roof jack 10, as seen along a Line I-I, as shown in FIG. 4 is depicted. The four (4) attachment cams 140 are secured to the attachment block 135 by the second fasteners 145. As the standing seam is inserted between the standing seam lock path "s" 175, the attachment cams 140 lock the standing seam into place via friction fit. As more force or weight is added to the attachment block 135, the more the pairs of the attachment cams 140 tighten along a locking travel path "t" 180. When the attachment block 135 is to be removed, it is simply tapped with a hammer in the opposite direction depicted by the standing seam lock path "s" 175, whereupon it is lifted free.

2. Operation of the Preferred Embodiment

The preferred embodiment of the present invention can be utilized by the common user in a simple and effortless manner with little or no training. It is envisioned that the roof jack 10 would be constructed in general accordance with FIG. 1 through FIG. 5. The user would procure the roof jack 10 from conventional procurement channels such as hardware stores, home improvement stores, mechanical supply houses, mail order and internet supply houses and the like.

During utilization of the roof jack 10, the following procedure would be initiated: the angular travel path "a" 110 would be adjusted using the locking fastener 35 withing the pivot track 105 to match the adjacent roof surfaces 90; the adjustable fastening pin 55 would be adjusted in the adjustable height slot 60 to conform to the pitch of the valley 95; the nailing surface 75 is attached to the roof surfaces 90 with first fasteners 100 through the first keyed holes 85 in the case of shingle roofs. In the instance of standing seam roofs, the standing seam roof connector 130 will be used instead of fasteners 100 to connect to the nailing surface 75. Once installed, the upper horizontal surface 15 and the lower horizontal surface 20 provide a stable surface or platform to work from.

After use of the roof jack 10, it is removed by uninstalling the first fasteners 100 or by removing the standing seam roof connector 130. The roof jack 10 may then be stored by hanging by the hanging ring 70, until needed again.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A valley roof jack, comprising:

an upper horizontal surface;

a lower horizontal surface disposed below the upper horizontal surface;

a horizontal support attached below the upper horizontal surface and the lower horizontal surface by a locking fastener, and a pivoting fastener configured to allow the upper horizontal surface and lower horizontal surface to pivot with respect to one another;

an inward support and an outward support supporting the horizontal support, a second pivoting fastener joining the horizontal support to the inward support, and a third pivoting fastener joining the inward support to the outward support; and a hanging ring disposed at a junction between the inward support and the outward support and is secured by the third pivoting fastener.

2. The valley roof jack, according to claim 1, wherein the upper horizontal surface and the lower horizontal surface are adapted to be kneeled upon directly by a user.

3. The valley roof jack, according to claim 1, wherein the upper horizontal surface and the lower horizontal surface are configured to be used as a support for a board.

4. The valley roof jack, according to claim 1, wherein the upper horizontal surface and the lower horizontal surface are pivoted with respect to the pivoting fastener, while the locking fastener rides in a pivot track for both the upper horizontal surface and the lower horizontal surface.

5. The valley roof jack, according to claim 1, wherein the locking fastener passes through a pair of pivot tracks before connecting to the horizontal support.

6. The valley roof jack, according to claim 1, wherein an upper end of the outward support includes an adjustable fastening pin that is positioned in an adjustable height slot so as to accommodate a roof having a plurality of different pitches.

7. The valley roof jack, according to claim 6, wherein the second pivoting fastener and the adjustable fastening pin join the horizontal support, the inward support, and the outward support to produce a triangular support.

8. The valley roof jack, according to claim 1, wherein an outward edge of the horizontal support having a stop flange to hold one or more jack boards.

9. The valley roof jack, according to claim 1, wherein the horizontal support, the inward support, and the outward support include a plurality of angular reinforcements for increased strength.

10. The valley roof jack, according to claim 1, wherein the hanging ring is configured to be used to hang the valley roof jack when not being used such as in storage.

11. The valley roof jack, according to claim 1, wherein the inward support is configured to rest against the valley while the hanging ring remains accessible for other fastening purposes.

12. The valley roof jack, according to claim 1, wherein the hanging ring is configured to be used to hang one or more tools, supplies or other items when the valley roof jack is being utilized on a roof.

13. The valley roof jack, according to claim 1, wherein the valley roof jack is configured to be secured to a roof surface by a nailing surface secured to the upper horizontal surface by a hinge.

14. The valley roof jack, according to claim 13, wherein the nailing surface includes a plurality of first keyed holes to allow for easy securing to a roof surface via one or more fasteners.

15. The valley roof jack, according to claim 13, wherein the valley roof jack includes a second nailing surface secured to the lower horizontal surface.

16. The valley roof jack, according to claim 1, wherein the valley roof jack is capable of being positioned between 2 roof surfaces that join together at a valley.

17. The valley roof jack, according to claim 13, wherein the valley roof jack is configured to be positioned in the valley and fastened to the roof surfaces using the nailing surface along with a plurality of first fasteners.

18. The valley roof jack, according to claim 1, wherein the valley roof jack is a support surface for 1 or 2 roof planks while supported with one or more conventional roof jacks.

19. The valley roof jack, according to claim 1, further comprising a standing seam roof connector having an attachment block with 4 attachment cams added to the valley roof jack when it is used on a standing seam roof.

20. The valley roof jack, according to claim 19, wherein the attachment block is removed when it is tapped in an opposite direction from a standing seam lock path and is lifted free.

* * * * *